US007131858B1

(12) United States Patent
Zerebilov

(10) Patent No.: US 7,131,858 B1
(45) Date of Patent: Nov. 7, 2006

(54) ANGLED COAXIAL CABLE CONNECTOR FOR MATING AXIS TERMINATION METHOD

(75) Inventor: Arkady Y. Zerebilov, Lancaster, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/016,919

(22) Filed: Dec. 21, 2004

(51) Int. Cl.
*H01R 13/56* (2006.01)

(52) U.S. Cl. ..... 439/446; 439/582

(58) Field of Classification Search ..... 439/446, 439/582, 902, 468
See application file for complete search history.

(56) References Cited

U.S. PATENT DOCUMENTS 5,288,242 A 2/1994 Muzslay
5,362,255 A 11/1994 Anhalt
5,380,219 A * 1/1995 Klier ..... 439/446
5,466,174 A 11/1995 Savage, Jr.
5,645,454 A 7/1997 Kosmala
6,017,242 A 1/2000 Kerrigan
6,338,645 B1 * 1/2002 Tan et al. ..... 439/446
6,419,519 B1 * 7/2002 Young ..... 439/446
6,817,899 B1 11/2004 Zerebilov

* cited by examiner

*Primary Examiner*—Javaid H. Nasri
(74) *Attorney, Agent, or Firm*—Daniel R. Edelbrock

(57) ABSTRACT

A right-angle connector for a coaxial cable has two main components. A first component and second component are made of electrically conductive material. The second component is attached to the first component such that the second component can rotate relative to the first component. The components are temporarily latched in an initial in-line configuration. In this configuration, the two components have a common, straight central axis and receive a terminal crimped on a stripped end of a coaxial cable. The terminal is fastened within a block of dielectric material in the first component at a mating end of the connector. The second component is then rotated to bend the cable end. The second component locks into a second configuration wherein a central axis of the second component is perpendicular to a central axis of the first component. An exposed braided conductive sheath of the cable end is clamped on a section of the second component by a cylindrical ferrule.

11 Claims, 5 Drawing Sheets

ANGLED COAXIAL CABLE CONNECTOR FOR MATING AXIS TERMINATION METHOD

BACKGROUND OF THE INVENTION

1. Field of the Invention

The invention relates in general to connectors for coaxial cables and more specifically to a straight or level connector that can be transformed into an angled connector after a terminated end of the coaxial cable is secured within the straight connector.

2. Discussion of Related Art

When coaxial cable connectors engage connection ports or printed circuit boards, it is sometimes necessary that a coaxial cable terminated within the connector be arranged at right or at other angles to the ports or boards. Often the connectors themselves are angled to meet this requirement. One traditional method of termination of a coaxial cable to an angled connector includes the use of two center contacts. A bent contact mounted within the connector mates with a contact soldered or crimped to the cable end. This can be expensive from the standpoint of a higher component count. Another typical method involves a soldering process. U.S. Pat. No. 5,362,255, for example, discloses soldering the inner conductor of a coaxial cable to a contact or terminal secured within a tubular portion of the connector. The solder connection is made at a right angle to a mate axis of the terminal. Two ferrule halves, one half extending at a fixed right angle from the tubular portion and the other half pivotally attached to the terminal portion, are then closed around the terminal end to form the rest of the right angle connector. The soldering process is relatively time-consuming and more expensive than a crimping termination. It would clearly be advantageous to terminate the coaxial cable to the connector using only one center contact and crimping process instead of soldering.

Some right angle coaxial cable connectors, such as those shown in U.S. Pat. Nos. 5,466,174 and 6,817,899, have hinged sections that, in the open position, enable insertion of bent terminals into the connector. Then the hinged sections are closed to complete the assembly. It is not always desirable to use bent terminals. Other designs provide provisions for holding the cable end in a bent position after a straight terminal is inserted into the connector. For example, in U.S. Pat. No. 6,017,242, a back unit of a coaxial cable connector supports a cable engagement device. The cable engagement device includes tangs, or an arcuate lip, that are meant to be soldered to the coaxial cable end after it has reached a selected bend. Again, a time-consuming soldering process is necessary. It can also be difficult to bend the cable without damaging the attachment between the terminal and cable end. It would seem that there would be substantial benefits to the art in having a coaxial cable connector that enables continued use of a standard straight terminal, aids in bending the cable without damaging the terminal-cable connection, and holds the cable in the bent position to form an angled connector without a soldering process.

SUMMARY OF THE INVENTION

Accordingly, it is an object of this invention to permit a mating axis termination of a coaxial cable to an angled connector.

Another object of this invention is to provide a connector that can be used to bend a coaxial cable after mating axis termination to form an angled connector.

A further object of this invention is to enable a relatively quick, inexpensive and automated assembly process for termination of a coaxial cable end to an angled connector.

In carrying out this invention in the illustrative embodiment thereof, a coaxial cable connector mainly comprises two electrically conductive, die-cast components. A first component has a dielectric insert with a central channel. A second component is hinged to the first component and has a central passage. In a first, temporarily latched configuration, the first and second components are straight or in-line, with the passage and channel aligned on a common central axis. A terminal crimped to an end of a coaxial cable is inserted through the passage of the second component into the channel of the dielectric insert within the first component. The terminal is held in position within the dielectric insert by cooperating retaining provisions on the terminal and insert.

The second component receives the coaxial cable end. A conductive outer braid of the cable end is fitted around a barrel section of the second component. A ferrule is slid over and crimped around the braid and barrel section to secure the cable end to the second component.

The second component is pivoted relative to the first component into a second, angled configuration, simultaneously bending the cable end and forming an angled connector. Locking structure on the first and second components reliably keep the components in this angled configuration.

The terminal and coaxial cable end are mated to the connector along a straight mating axis, doing away with the need for a bent terminal or two separate terminals. In effect, tooling that is normally required to bend the cable is integrated or incorporated into the structural features of the connector. The locking structure eliminates the need for a soldering process. This results in a low-cost connector with a fast coaxial cable termination method that lends itself to automation.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
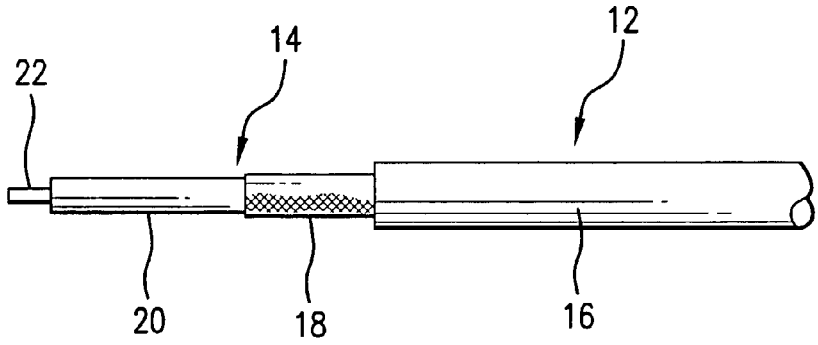
FIG. 1 illustrates an enlarged coaxial cable end with layers stripped back to predetermined lengths in preparation for insertion into a coaxial cable connector according to the present invention.

Referring now to FIG. 1, a coaxial cable 12 with a termination end 14 is shown. An outer jacket 16 of the termination end 14 is stripped to expose a specific length. A sheath or braided outer conductor 18 is cut back to expose a specific length of inner insulation layer 20. A part of the inner insulation layer 20 is stripped off the termination end to expose a core conductor 22 of the cable. The lengths of the exposed core conductor 22, exposed inner insulation layer 20, and exposed braided outer conductor 18 are predetermined to fit within or around certain parts of a connector according to the present invention, as will be described.

Figure 2:
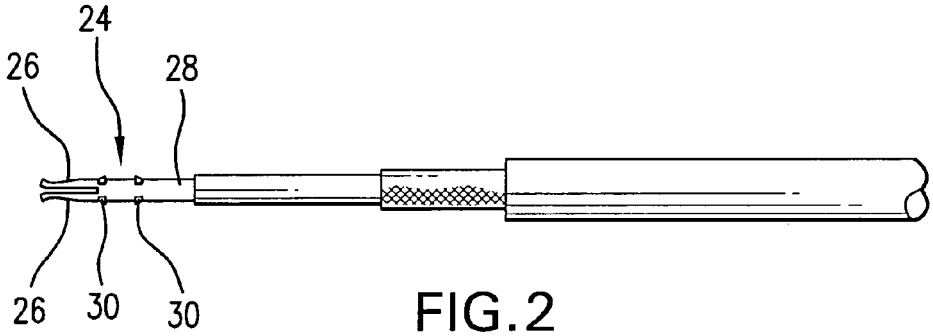
FIG. 2 is a side view of a terminal attached to the coaxial cable end of FIG. 1.
Figure 3:
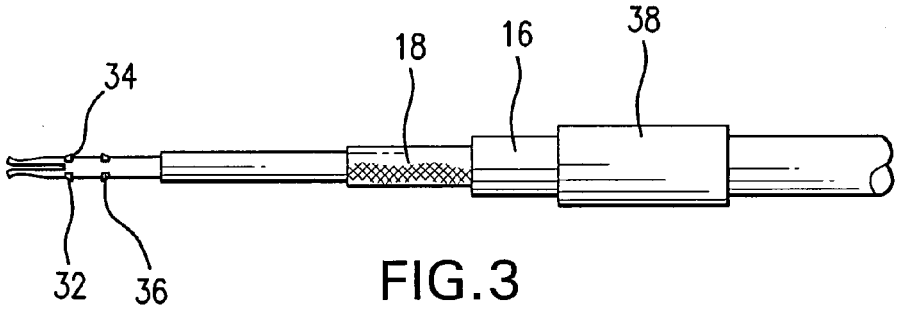
FIG. 3 depicts a ferrule slid over the terminal and coaxial cable end of FIG. 2.
Figure 4:
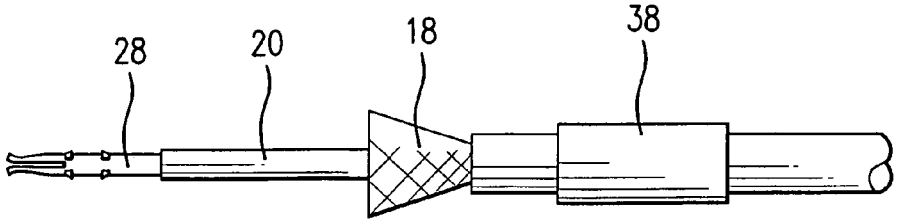
FIG. 4 shows a sheath layer of the coaxial cable end flared outward in further preparation for attachment of the cable end, terminal and ferrule of FIG. 3 to a connector according to the present invention.

As illustrated in FIGS. 2–4, to further prepare the termination end 14, a center contact or terminal 24 is crimped to the exposed core conductor 22. The female terminal illustrated is meant to be an example. A different type of female terminal, as well as various types of male terminals, could alternatively be used in the connector. This particular female terminal 24 is stamped or otherwise manufactured from an electrically-conductive metal such as brass or stainless steel. The terminal has resilient, opposed contact arms 26 configured to receive and electrically mate with a male terminal pin. The arms 26 extend from a barrel-shaped body 28 that can be crimped on the exposed core conductor 22 for electrical contact in a conventional manner. The body 28 has partially deflectable retention means or barbs 30 on its outer circumference and spaced along its length for a purpose that will be described. The barbs 30 are depicted as being in two pairs, a first, forward pair being generally trapezoidal-shaped to form ramped or inclined surfaces 32 leading to catch edges 34 and a second, rearward pair being generally trapezoidal-shaped to form abutting edges 36. The catch edges 34 and abutting edges 36 are substantially perpendicular to the body 28. Other shapes and arrangements of deflectable retention barbs could be substituted for those depicted.

In FIG. 3, a separate cylindrical ferrule 38, fashioned from a ductile, conductive metal such as brass, is slipped over the termination end 14 to a temporary position on the outer jacket 16. As demonstrated in FIG. 4, the exposed braided outer conductor 18 is then flared outward, away from the inner insulation layer 20. The termination end 14 of the coaxial cable 12 is now completely prepared for insertion into the connector.

Figure 5:
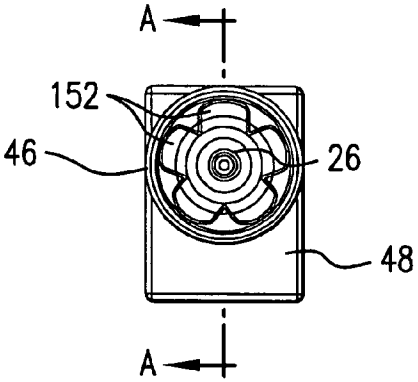
FIG. 5 is an enlarged front view of a coaxial cable connector according to the present invention in a straight or in-line configuration with an inserted terminal and cable end.
Figure 6:
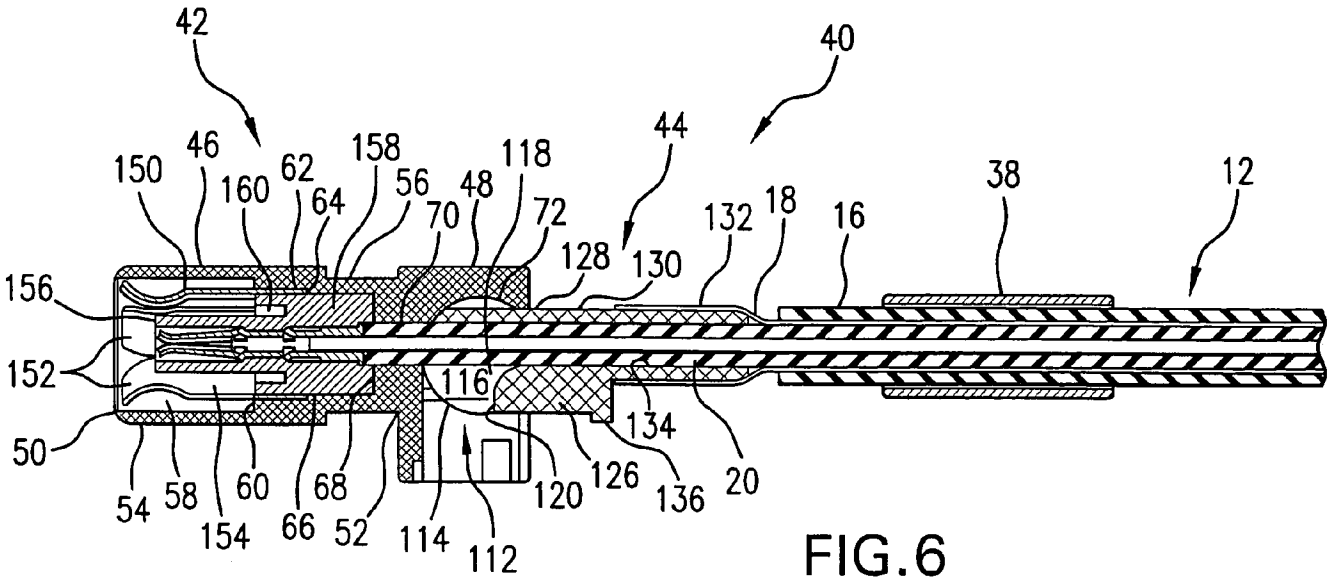
FIG. 6 is an enlarged cross-sectional side view of the connector in the in-line configuration, taken on section line A—A of FIG. 5.

Referring now to FIGS. 5 and 6, a connector 40 according to the present invention has a first main component 42 and a second main component 44. In the figures, the connector components, as well as the coaxial cable, are drawn a few times larger than actual size to improve clarity. The components 42 and 44 may, for example, be die-cast in two pieces from an electrically conductive metal or material, such as zinc or a zinc-aluminum alloy. The first component 42 has a mating section 46 and an attachment section 48. The mating section 46 is a hollow cylinder with a first, mating end 50 and a second end 52 integral with the attachment section 48. The cylinder has a longer, wider portion 54 extending back from the mating end 50 and stepping down to a relatively shorter, slightly narrower portion 56 adjacent the attachment section 48. Inner diameters of the mating section 46 reduce in size three times. A first, larger inner cavity 58 extends from the mating end 50 to a first step 60 about two-thirds of the distance back along the wider portion 54. A second cavity 62, slightly smaller in diameter, extends for most of the rest of the length of the wider portion 54 to a second step 64. A third cavity 66 extends approximately half-way through the narrower portion 56 and ends at an inner wall 68. A passage 70 extends through the inner wall 68 into the attachment section 48. The passage 70 has a diameter slightly larger than an outer diameter of the inner insulation layer 20 of the cable 12.

Figure 10:
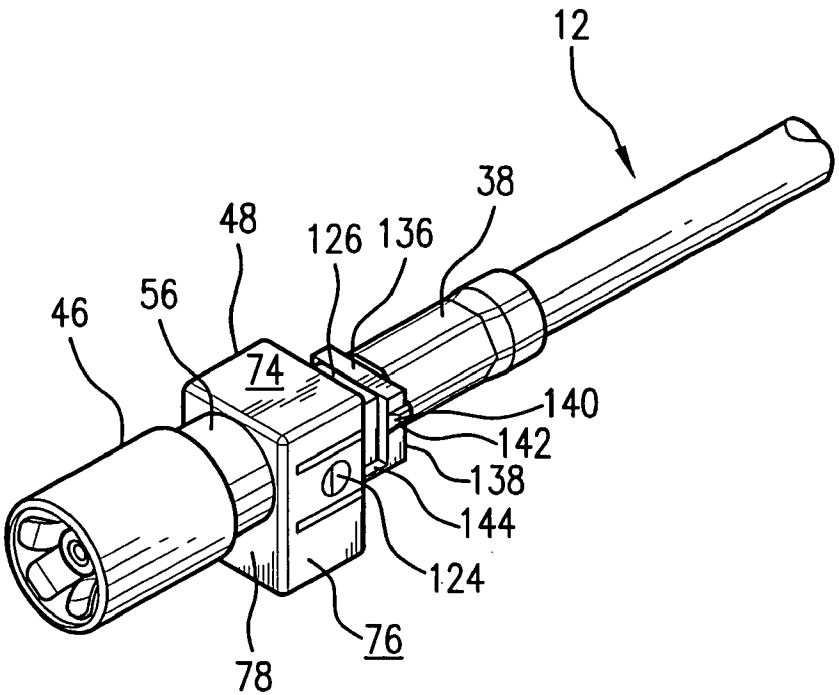
FIG. 10 is a perspective view of the connector in the in-line configuration.
Figure 13:
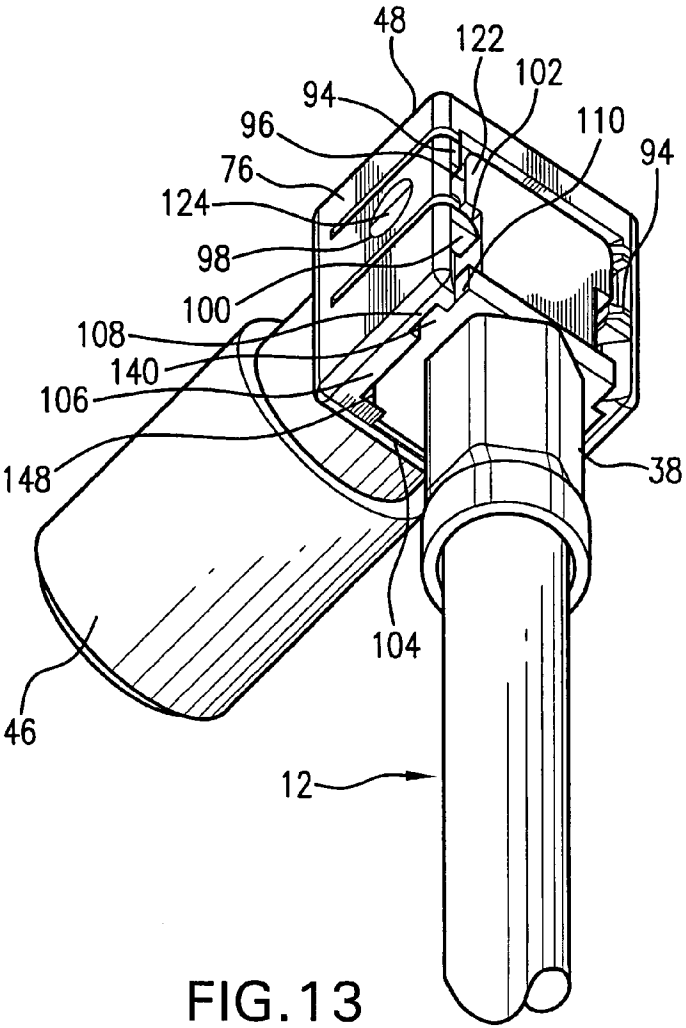
FIG. 13 is an enlarged, rear perspective view of the connector and cable end in the right-angle configuration.
Figure 12:
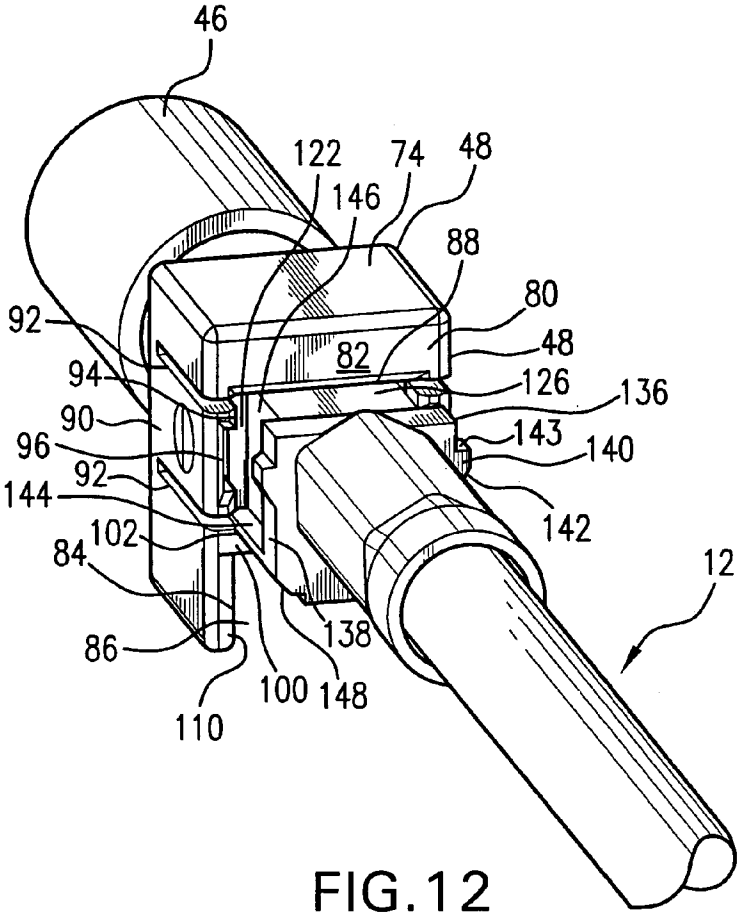
FIG. 12 is an enlarged, rear perspective view of the connector in the in-line configuration.

As best shown in FIGS. 10, 12 and 13, the attachment section 48 is generally rectangular in shape and includes a curved socket 72 for receiving part of the second component. The passage 70 extends into the curved socket. As orientated in the Figures, the attachment section has a top wall 74, two side walls 76, and a front wall 78 integral with the second end 52 of the mating section 46. A rear wall 80 opposite the front wall mainly comprises a rear surface 82 of the top wall 74 and rear surfaces 84 of each side wall 76. A large opening 86 through the rear wall 80 formed between these surfaces leads to the socket 72.

The large opening 86 is bounded by a generally straight lower edge 88 of the rear surface 82 and by the side walls 76 and their rear surfaces 84. Each side wall 76 has a generally central region 90 formed between two parallel, spaced slits 92 extending from close to the front wall 78 to and through the rear surfaces 84 of each side wall. The central regions 90 have guide ridges 94 within the socket 72 just inward of each slit 92. A wide groove 96 extends between each set of ridges 94. A circular aperture 98 extends through each region 90. Under the lowest slit 92 on each side wall 76 adjacent the rear surfaces 84 are latch tabs 100 extending into the opening 86. The latch tabs 100 have beveled or inclined surfaces 102 facing the opening in a generally upward direction.

The attachment section does not have an underside except for a narrow ledge 104 formed by a bottom edge of the front wall 78 and two narrow ledges 106 formed by bottom edges of the side walls 76, as most clearly illustrated in FIG. 13. The narrow ledges form a patterned opening in the underside of the attachment section 48. There is a slot 108 in each narrow ledge 106. Chamfered or beveled surfaces 110 where the ledges 106 face the opening 86 lead to each slot 108.

Referring back to FIG. 6, the second main component 44 of the connector 40 has a ball or rounded section 112 with a curved wall 114 for fitting into and engaging the curved socket 72 of the attachment section 48 of the first main component 42. The curved wall 114 is bordered by parallel sides 116 and has in interior chamber 118 with a ninety-degree arch 120. Each parallel side 116 has a raised bulge or outcropping 122, illustrated in FIGS. 12 and 13. The outcroppings 122 fit into the grooves 96 between the ridges 94 on each side wall 74 of the attachment section 48 of the first component 42. The outcroppings have hinge pockets or inner holes (not shown) that align with the apertures 98 through the central regions 90 in the side walls 76 of the attachment section 48. The apertures and holes receive a peg or shaft of a hinge or pivot pin 124. The pivot pins 124 could be snap-fit in the apertures 98 or fastened in some other conventional manner. The pivot pins enable the main second component 44 to rotate relative to the first component 42 about a pivot axis perpendicular to a terminal insertion axis, with the rounded section 112 sliding along the curved socket 72.

The rounded section 112 is integral with a block section 126 at a first end 128 of the block section. The block section 126 has a second, opposite end 130. A barrel section 132 extends from the opposite end 130. The barrel section 132 has an outer diameter slightly smaller than an inner diameter of the ferrule 38 and an inner passage 134 sized to receive the insulation layer 20 of the cable 12. The inner passage 134 extends all the way through the block section 126 into the interior chamber 118 of the rounded section 112 of the second main component 44 into communication with the passage 70 in the attachment section 48 of the first main component 42.

The block section 126 of the second component 44 has a flange 136 (FIG. 12) at the second end 130. The flange 136 has opposite edges 138. A locking projection 140 extends outward from each opposite edge 138. The locking projections have ramped or inclined surfaces 142, facing generally downward in FIG. 12, leading to right-angled lock surfaces 143. The block section 126 also includes protruding lower shelves 144 extending along its length on each side 146. The shelves each have an underside 148, best shown in FIG. 12, matching the slope or incline of the latch tab inclined surfaces 102 on the side walls 76 of the attachment section 48.

Figure 7:
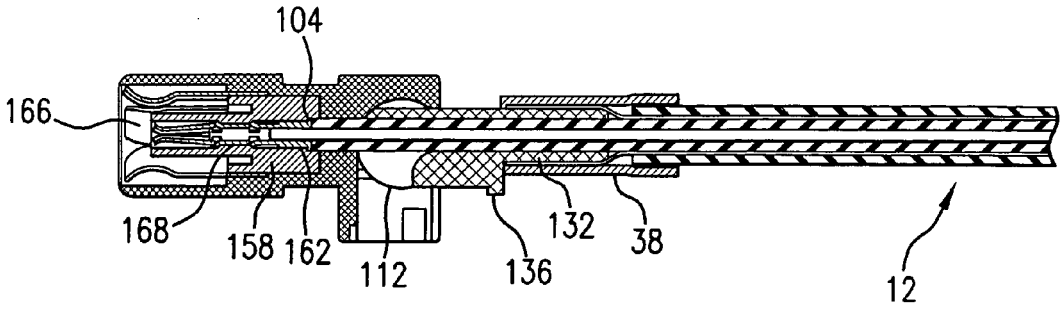
FIG. 7 is a cross-sectional side view similar to FIG. 6 but illustrating the ferrule crimped around a section of the connector.
Figure 8:
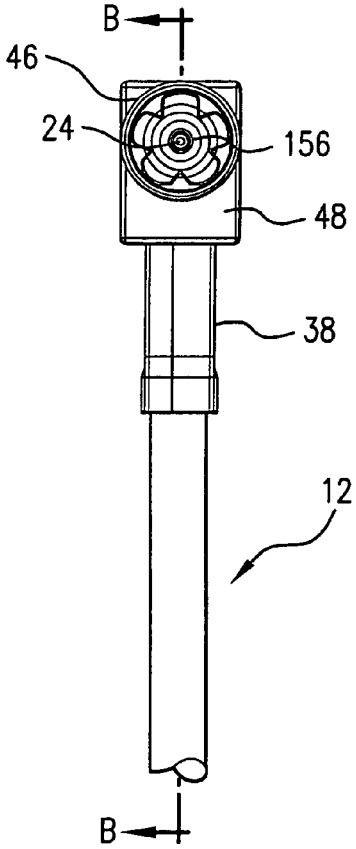
FIG. 8 is a front view of the connector, terminal and cable end in the right-angle configuration.
Figure 9:
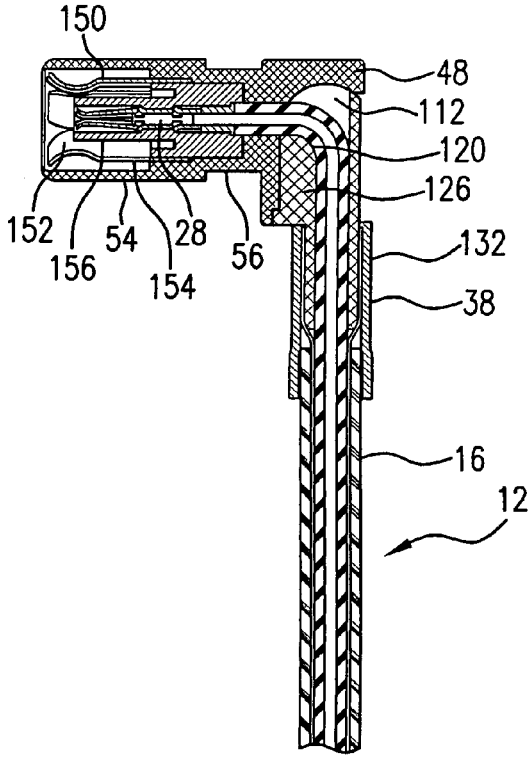
FIG. 9 is a cross-sectional side view taken on section line B—B of FIG. 8.

As revealed by FIGS. 6, 7 and 9, the final connector assembly includes a couple of other components in addition to the first and second main components 42 and 44. The mating section 46 of the first component 42 receives a supplementary outer female socket or contact 150 constructed to accept a standard male connector for mating with the female terminal 24. The outer female contact has spring fingers 152 extending from a ring segment 154. The ring segment 154 fits into the second inner cavity 62 of the mating section with the spring fingers extending through the first inner cavity 58. The ring segment is held in the second cavity by a force-fit and abuts against the second step 64.

A dielectric insert, made of a material such as Nylon, Teflon, polybutylene-terephalate or any of a variety of extended plastics, has a first tubular element 156 extending from a second, larger diameter tubular element 158. An annular recess 160 is formed between the first tubular element 156 and the second tubular element 158 prior to the location where the elements join together. A central channel 162 extends through both elements. The channel 162 has an insertion end 164 widened to the diameter of the passage 70 and a mating terminal receiving end 166. Approximately mid-way along the channel 162, the channel narrows for a span 168 equal in length to the distance between the pairs of barbs 30 on the terminal body 28. The second tubular element 158 of the dielectric insert is force fit into the second and third inner cavities 62 and 66, respectively. In the second cavity, the ring segment 154 of the outer female contact 150 is sandwiched between the surface of the second cavity and the tubular element 158 of the dielectric insert.

To use the connector, the second main component 44 is latched in a straight or in-line configuration with the first main component 42. In this first position or configuration, illustrated in FIG. 6, the inner passage 134 through the barrel section 132 and block section 126 of the second component aligns on a straight axis with the interior chamber 118 of the rounded section 112 of the second component. The inner passage 134 and interior chamber 118 also align on a straight axis with the passage 70 through the attachment section 48 and the narrower portion 56 of the mating section 46 of the first component. This straight axis continues through the central channel 162 in the tubular elements 156 and 158 of the dielectric insert.

The second component 44 is secured in this configuration by the inclined surfaces 102 of latch tabs 100 on the side walls 76 of the attaching section 48 acting against the matching slopes of the undersides 148 of the lower shelves 144 on the sides 146 of the block section 126, as depicted in FIG. 12. The tabs and shelves form complimentary latch means for a maintainable terminal-insertion configuration. Therefore, a straight mating axis is provided for inserting a terminal 24 on the end of a coaxial cable 12 into the connector. The terminal and prepared terminated end of the cable are inserted through the second component into the first component. The first pair of partially deflectable retention barbs 30 on the terminal are forced past the span 168 of narrowed diameter in the dielectric insert channel 162 until the span is jammed between catch edges 34 and the abutting edges 36 of the second pair of barbs. The terminal 24 is thereby secured in position within the first tubular element 156 of the dielectric insert. The dielectric insert physically and electrically isolates the terminal from the mating section 46 of the first component.

As best illustrated in FIG. 7, the previously flared braided outer conductor 18 of the cable end is wrapped or compressed around the barrel section 132 of the second component 44. The ferrule 38 is slid over the barrel section to abut against the flange 136 of the block section 126. A crimping tool is then used to clamp the ferrule around the braided outer conductor 18 and barrel section 132, retaining the cable end to the second component of the connector. It is possible to wait until after the rotation of the second component to the right-angle position before crimping the ferrule 38 on the barrel section 132. The terminal securement in the dielectric insert can be designed to be strong enough to reliably retain the cable end in position during the bending movement.

Figure 11:
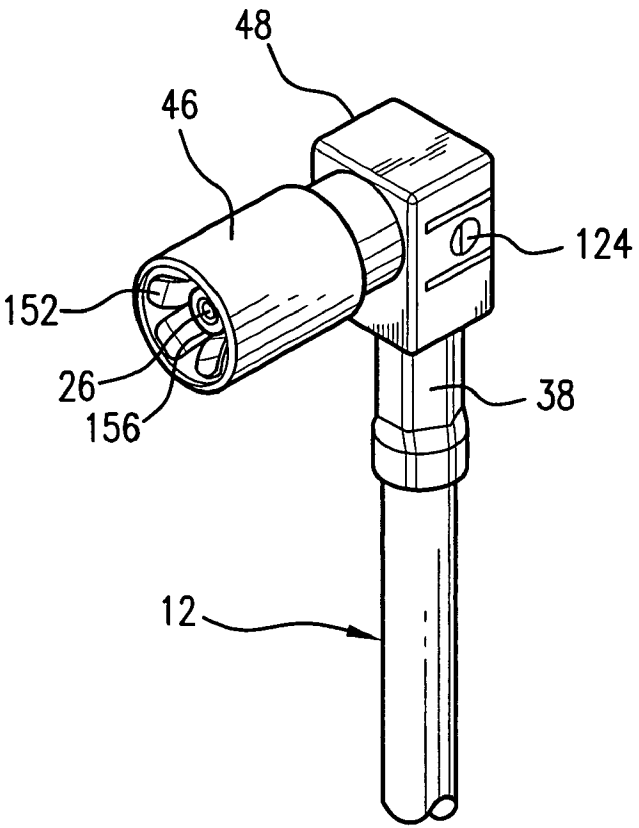
FIG. 11 is a perspective view of the connector after being manipulated to a right-angle configuration.

To configure the assembly as a right-angle connector, the second component 44 is forcefully rotated about the pivot pins 124 relative to the first component 42 to overcome the hold of the latch tabs 100 and shelves 144 (FIG. 12). The cable end in the second component bends around the arch 120 in the rounded section 112. When the second component moves into the right-angle position, the locking projections 140 on the flange 136 of the block section 126 snap into the slots 108 in the narrow ledges 106 on the underside of the attachment section 48 (FIG. 13). This causes an audible click. The second component is thereby fixed in the second, right-angle position or configuration. The connector with a straight terminal-mating axis thereby becomes the right-angle connector illustrated in FIGS. 11 and 13. The assembly is then received in a plastic, electrically non-conductive housing (not shown). The ferrule 38 and outer female contact 150 act as electrical grounds and shields for the terminal and cable.

The described assembly process can be easily automated. The slots on the attachment section of the first component and the locking projections on the block section of the second component form complimentary locking means to provide a stable right-angle connector. However, the locking means can be replaced by other types of locking structure and the locking structure can be positioned to hold the components at other angles to create other angled connectors depending on the requirements of the connector environment. Some connector environments may require a more robust locking means than the locking projections 140 and the slots 108. For example, the attachment section 48 can have a portion or lip that extends into contact with the barrel section 132 when the second component is in the right-angle configuration. The ferrule 38 could then be crimped around both the barrel section and the lip so it simultaneously clamps the braided conductor 18 around the barrel section and locks the barrel section at a right angle to the attachment section. Similarly, the pivot pins can be replaced by other hinge structure enabling the second component to rotate relative to the first component.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A coaxial cable connector comprising:

a first component for receiving a terminal attached to an inner conductor exposed at an end of a coaxial cable, the first component including a socket;

a second component for receiving an exposed insulation layer at the end of the coaxial cable, the second component having a rounded section for being movably secured within the socket of the first component on a pivot axis enabling rotation of the second component between a first position in-line with the first component and a second position wherein the second component extends at an angle to the first component, the second component further including a barrel section; and a ferrule positioned to retain an outer conductor exposed at the coaxial cable end around the barrel section of the second component.

2. The connector of claim 1 wherein the angle is a right angle.

3. The connector of claim 1 further including means for latching the second component in the first position.

4. The connector of claim 1 further including means for locking the second component in the second position.

5. The connector of claim 4 wherein the means for locking the second component in the second position has a feature for causing an audible snap when the movement to the second position is completed.

6. The connector of claim 5 wherein the means for locking the second component in the second position comprises at least one projection on the second component and at least one slot within the first component into which the at least one projection snaps when the second component is rotated to extend at a right angle from the first component.

7. The connector of claim 1 wherein the first and second components are made of an electrically conductive material.

8. The connector of claim 7 further comprising a block of dielectric material fitted into the first component in a location for electrically isolating the terminal from the first component.

9. The connector of claim 8 wherein the dielectric block has an inner channel for receiving the terminal and a narrowed span within the channel for engaging and holding the terminal in the dielectric block and first component.

10. The connector of claim 1 further comprising a block section for joining the rounded section and barrel section of the second component.

11. A coaxial cable connector comprising:

a first component for receiving a terminal attached to an inner conductor exposed at an end of a coaxial cable;

a second component for receiving an exposed insulation layer at the end of the coaxial cable, the second component being movably secured to the first component on a pivot axis enabling rotation of the second component between a first position in-line with the first component and a second position wherein the second component extends at an angle to the first component, the first and second components being made of an electrically conductive material;

a ferrule positioned to retain an outer conductor exposed at the coaxial cable end around a section of the second component;

a block of dielectric material fitted into the first component in a location for electrically isolating the terminal from the first component; and a supplementary electrical contact sandwiched between the dielectric block and the first component.

* * * * *